US008781391B2

(12) United States Patent
Huschke

(10) Patent No.: US 8,781,391 B2
(45) Date of Patent: Jul. 15, 2014

(54) HIERARCHICAL BROADCAST TRANSMISSION VIA MULTIPLE TRANSMITTERS

(75) Inventor: Jorg Huschke, Aachen (DE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 1143 days.

(21) Appl. No.: 12/375,254

(22) PCT Filed: Jul. 27, 2006

(86) PCT No.: PCT/EP2006/007464

§ 371 (c)(1), (2), (4) Date: Nov. 10, 2009

(87) PCT Pub. No.: WO2008/011898

PCT Pub. Date: Jan. 31, 2008

(65) Prior Publication Data

US 2010/0056041 A1 Mar. 4, 2010

(51) Int. Cl.
*H04H 20/71* (2008.01)

(52) U.S. Cl.
USPC ..... 455/3.01; 455/449; 370/334

(58) Field of Classification Search
CPC ..... H04H 20/40; H04H 60/42; H04W 72/005
USPC ..... 455/3.01
See application file for complete search history.

(56) References Cited

U.S. PATENT DOCUMENTS

| | | | | |
|---|---|---|---|---|
| 4,912,475 | A * | 3/1990 | Counselman, III | 342/352 |
| 5,355,515 | A * | 10/1994 | Sicher | 455/438 |
| 5,734,967 | A * | 3/1998 | Kotzin et al. | 455/63.1 |
| 5,787,345 | A * | 7/1998 | Moon | 455/436 |
| 5,913,168 | A * | 6/1999 | Moreau et al. | 455/441 |
| 5,970,232 | A * | 10/1999 | Passint et al. | 709/238 |
| 6,363,252 | B1 * | 3/2002 | Hamalainen et al. | 455/436 |
| 6,477,376 | B1 * | 11/2002 | Carter | 455/446 |
| 6,628,620 | B1 * | 9/2003 | Cain | 370/248 |
| 6,683,865 | B1 * | 1/2004 | Garcia-Luna-Aceves et al. | 370/349 |
| 6,735,177 | B1 * | 5/2004 | Suzuki | 370/238 |
| 6,782,262 | B1 * | 8/2004 | Lundborg | 455/449 |
| 6,907,243 | B1 * | 6/2005 | Patel | 455/442 |

(Continued)

FOREIGN PATENT DOCUMENTS

| | | |
|---|---|---|
| CN | 1153444 A | 7/1997 |
| EP | 1 039 661 A1 | 9/2000 |

OTHER PUBLICATIONS

Pabst, R et al. Relay-Based Deployment Concepts for Wireless and Mobile Broadband Radio. IEEE Communications Magazine. pp. 80-89. Sep. 2004.

*Primary Examiner* — Hai V Nguyen

(57) ABSTRACT

A technique for controlling a wireless broadcast transmission of media data via multiple transmitter sites into a broadcast area with different inter-site distances is proposed. The broadcast area comprises a region of large inter-site distance (ISD) and a region of small inter-site distance. The technique provides for a high spectral efficiency in regions of small ISD and at the same time for an acceptable reception quality in regions of large ISD. A first transmission is initiated into the broadcast area, wherein the first transmission is adapted for reception in a first of the regions. A second transmission is initiated into a second of the regions, the second transmission being adapted for reception in the second region.

23 Claims, 9 Drawing Sheets

(56) References Cited

U.S. PATENT DOCUMENTS

| | | | | |
|---|---|---|---|---|
| 6,928,268 | B1 * | 8/2005 | Kroner | 455/69 |
| 7,068,624 | B1 * | 6/2006 | Dantu et al. | 370/331 |
| 7,181,170 | B2 * | 2/2007 | Love et al. | 455/67.13 |
| 7,286,826 | B2 * | 10/2007 | Kim et al. | 455/444 |
| 7,295,533 | B2 * | 11/2007 | Alicherry et al. | 370/328 |
| 7,346,354 | B2 * | 3/2008 | Patel | 455/450 |
| 7,483,403 | B2 * | 1/2009 | Herrmann et al. | 370/310 |
| 7,522,513 | B2 * | 4/2009 | Henriksson | 370/208 |
| 7,532,857 | B2 * | 5/2009 | Simon | 455/3.01 |
| 7,586,853 | B2 * | 9/2009 | Bonsma et al. | 370/254 |
| 7,660,275 | B2 * | 2/2010 | Vijayan et al. | 370/312 |
| 7,660,368 | B2 * | 2/2010 | Ling et al. | 375/332 |
| 7,724,838 | B2 * | 5/2010 | Mantravadi | 375/295 |
| 7,725,799 | B2 * | 5/2010 | Walker et al. | 714/755 |
| 7,729,337 | B2 * | 6/2010 | Saleh et al. | 370/351 |
| 7,787,361 | B2 * | 8/2010 | Rahman et al. | 370/217 |
| 7,839,814 | B2 * | 11/2010 | Narasimha et al. | 370/328 |
| 7,917,164 | B2 * | 3/2011 | Rao | 455/522 |
| 7,940,685 | B1 * | 5/2011 | Breslau et al. | 370/251 |
| 7,940,740 | B2 * | 5/2011 | Krishnamurthy et al. | 370/344 |
| 8,023,450 | B2 * | 9/2011 | Abedi | 370/328 |
| 8,059,608 | B2 * | 11/2011 | Malladi | 370/334 |
| RE43,138 | E * | 1/2012 | Hasegawa | 455/512 |
| 8,150,622 | B2 * | 4/2012 | Kim | 701/428 |
| 8,223,853 | B2 * | 7/2012 | Vijayan et al. | 375/260 |
| 8,374,616 | B2 * | 2/2013 | Huschke et al. | 455/449 |
| 8,422,438 | B2 * | 4/2013 | Shu et al. | 370/329 |
| 8,570,982 | B2 * | 10/2013 | Malladi | 370/334 |
| 8,611,823 | B2 * | 12/2013 | Weng et al. | 455/63.1 |
| 8,639,251 | B2 * | 1/2014 | Gunnarsson et al. | 455/437 |
| 2001/0049281 | A1 * | 12/2001 | Duplessis et al. | 455/422 |
| 2003/0153338 | A1 * | 8/2003 | Herz et al. | 455/517 |
| 2004/0044468 | A1 * | 3/2004 | Adachi | 701/208 |
| 2004/0076129 | A1 | 4/2004 | Vannucci | |
| 2004/0151147 | A1 * | 8/2004 | Huckins | 370/338 |
| 2004/0166863 | A1 * | 8/2004 | Kim et al. | 455/449 |
| 2004/0224719 | A1 * | 11/2004 | Nounin et al. | 455/553.1 |
| 2004/0246911 | A1 * | 12/2004 | Bonsma et al. | 370/254 |
| 2005/0053069 | A1 * | 3/2005 | Lundby | 370/390 |
| 2005/0059437 | A1 * | 3/2005 | Son et al. | 455/574 |
| 2005/0122928 | A1 * | 6/2005 | Vijayan et al. | 370/312 |
| 2005/0143974 | A1 * | 6/2005 | Joly | 704/201 |
| 2005/0220001 | A1 * | 10/2005 | Henriksson | 370/208 |
| 2006/0023748 | A1 * | 2/2006 | Chandhok et al. | 370/469 |
| 2006/0159359 | A1 * | 7/2006 | Lee | 382/240 |
| 2006/0227732 | A1 * | 10/2006 | Wang | 370/310 |
| 2006/0232447 | A1 * | 10/2006 | Walker et al. | 341/50 |
| 2006/0280262 | A1 * | 12/2006 | Malladi | 375/299 |
| 2007/0008927 | A1 * | 1/2007 | Herz et al. | 370/331 |
| 2007/0008941 | A1 * | 1/2007 | Narasimha et al. | 370/338 |
| 2007/0060187 | A1 * | 3/2007 | Englund et al. | 455/522 |
| 2007/0104096 | A1 * | 5/2007 | Ribera | 370/229 |
| 2007/0110000 | A1 * | 5/2007 | Abedi | 370/332 |
| 2007/0110064 | A1 * | 5/2007 | Ohkubo et al. | 370/390 |
| 2007/0191013 | A1 * | 8/2007 | Gunnarsson et al. | 455/438 |
| 2007/0208737 | A1 * | 9/2007 | Li et al. | 707/6 |
| 2007/0274280 | A1 * | 11/2007 | Haas et al. | 370/348 |
| 2008/0274759 | A1 * | 11/2008 | Chen et al. | 455/507 |
| 2008/0316052 | A1 * | 12/2008 | Ruffini | 340/901 |
| 2009/0219875 | A1 * | 9/2009 | Kwak et al. | 370/329 |
| 2009/0225872 | A1 * | 9/2009 | Simon | 375/240.27 |
| 2009/0279469 | A1 * | 11/2009 | Wang et al. | 370/312 |
| 2010/0056041 | A1 * | 3/2010 | Huschke | 455/3.01 |
| 2010/0098192 | A1 * | 4/2010 | Ling et al. | 375/332 |
| 2010/0322350 | A1 * | 12/2010 | Malladi | 375/299 |
| 2010/0323707 | A1 * | 12/2010 | Huschke et al. | 455/450 |
| 2011/0021224 | A1 * | 1/2011 | Koskinen et al. | 455/507 |
| 2012/0178477 | A1 * | 7/2012 | Morgan et al. | 455/456.6 |
| 2012/0188878 | A1 * | 7/2012 | Simon | 370/241 |
| 2012/0309420 | A1 * | 12/2012 | Morgan et al. | 455/456.1 |
| 2013/0072227 | A1 * | 3/2013 | Morgan et al. | 455/456.1 |

* cited by examiner

HIERARCHICAL BROADCAST TRANSMISSION VIA MULTIPLE TRANSMITTERS

FIELD OF THE INVENTION

The invention relates generally to the field of wireless broadcast transmissions of media data. More specifically, the invention relates to a technique for controlling a wireless broadcast transmission of media data via multiple transmitter sites into a broadcast area with different inter-site distances.

BACKGROUND OF THE INVENTION

Broadcasting services provide for the transmission of media data, for example streaming audio and/or video data, from typically a single data source to multiple receivers. Modern broadcasting services often make use of a wireless technology to transmit the media data over at least an essential segment of the way from the data source to the receivers. Wireless broadcasting services may not only be provided by classical radio stations and television networks, but also by mobile networks, for example GSM (Global System for Mobile Communications) or UMTS (Universal Mobile Telecommunications System) networks.

Each broadcasting service is provided into a broadcast area, i.e. into a geographical area in which the media data can be received. In case of a PLMN (Public Land Mobile Network), the broadcast area may comprise the whole network. On the other hand, a broadcast area may be configured to be as small as a single radio cell of a cellular network. In general, a broadcast service area comprises a reasonable part of a PLMN.

Each network cell is served by a transmitter site comprising at least one transmitter or transmitter station. For example, a transmitter site in a GSM network comprises a BTS (Base Transceiver Station) which may be controlled by a BSC (Base Station Controller); a transmitter site in a UMTS network comprises a Node-B which may be controlled by an RNC (Radio Network Controller). Consequently, multiple transmitter sites are required at least for broadcast areas comprising many cells. The multiple transmitter sites may use the same frequency resource, i.e. operate on the same frequency; this operational mode is called Single Frequency Network (SFN).

To minimize interference, the transmitter sites of an SFN are typically run synchronised with each other, i.e. all transmitters of the multiple sites synchronously transmit the same broadcast signal. This may be achieved for example by using GPS (Global Positioning System) or a reference clock provided by one of the transmitter sites or by a control node in the broadcast network. A receiver, e.g. a receiver component in a user equipment of the mobile network, thus receives broadcast signals of multiple nearby transmitter sites.

The receiver may superpose the signals received from transmitter sites within a certain distance from the receiver. Signals received from more distant transmitter sites contribute to the interference level at the location of the receiver. As an example, an OFDM (Orthogonal Frequency Division Multiplex) broadcast system uses a particular guard interval the length of which determines the maximum distance for constructive superposition. Examples of OFDM-based broadcast systems are DVB-T (Digital Video Broadcasting-Terrestrial) and DAB (Digital Audio Broadcasting).

To achieve at the same time a predetermined minimum reception quality in terms of a maximum bit or packet error rate over the entire broadcast area and a high spectral efficiency (ratio of media data bit rate to required transmission bandwidth), an important measure is provided by the Signal to Interference plus Noise Ratio (SINR). The lower the SINR, the higher the error rate. In order to achieve a desired error rate and bit rate for a low SINR, a transmission mode is required which utilizes more radio resources than a transmission mode adequate for a high SINR, thus decreasing the spectral efficiency.

The transmission mode determines the coverage of the transmission, i.e. the zone around a transmission site wherein reception of the transmitted broadcast signal is possible for a receiver with a bit or packet error rate below a predetermined quality threshold. In cellular networks, radio resources may for example be specified according to one or more of the aspects time, frequency, transmit power and spreading code. Accordingly, the transmission mode is specified by choosing for example a particular transmit power, a particular channel coding (e.g., higher or lower code rates), particular spreading codes with specific spreading factors, etc.

By its definition, the SINR at a receiver at a particular location in the broadcast area increases with the received aggregate useful signal, which is the superposition of all useful signals from individual transmitters, and decreases with the aggregate interference, which is the superposition of all interfering signals from individual transmitters, and with the noise level, which may be assumed to be a location independent constant. Depending on the deployment of the broadcast network, either the interference can dominate the noise or vice versa. If the noise dominates, the SINR increases with decreasing distance to the transmitters. Even if the interference dominates, generally the SINR increases with decreasing distance to the transmitters, because the interference will increase less than the useful signal.

Accordingly, the minimum SINR in an SFN broadcast area is generally dependent on the inter-site distance (ISD), defined as the average distance between any pair of transmitter sites in a region of the broadcast area. The SINR typically decreases with increasing ISD. The minimum SINR in a broadcast area typically occurs in a region of the broadcast area with a large ISD.

The minimum SINR (which may be a percentile) in a given broadcast area is generally determined by measurement. Then a transmission mode is chosen to achieve the desired error rate. However, in an SFN network, increasing for example the transmit power might be sufficient to increase the Signal to Noise Ratio, but at the same time may increase interference and thus lead to a decreasing SINR. The minimum SINR in the broadcast area may also decrease (and may occur at different locations in the broadcast area).

Using different transmission modes on the same radio resources would make it more difficult to superpose the signals received from transmitter sites using the different modes, in particular in the case of SFNs. In SFN broadcast areas comprising a region or regions of small ISD (e.g., cities) and a region or regions of large ISD (e.g., rural areas), it is thus difficult to find an optimal transmission mode. In case a transmission mode is chosen which is sufficiently robust to achieve full coverage also in the region of large ISD, this transmission mode will not exploit the higher SINR achieved in regions of small ISD and therefore the spectral efficiency in these regions will be lower than in the case that a less robust transmission mode had been used that still achieves full coverage in regions of small ISD.

In regions of small ISD the SINR is high. This allows to achieve full coverage even for transmission modes which are less robust and can therefore provide a higher throughput.

These transmission modes are however not sufficiently robust for the regions of large ISD and therefore cannot achieve full coverage in these regions.

Accordingly, there is a need for a technique for controlling a wireless broadcast transmission of media data via multiple transmitter sites into a broadcast area with different inter-site distances, wherein the technique provides for a high spectral efficiency in regions of small ISD and at the same time for an acceptable reception quality in regions of large ISD.

SUMMARY OF THE INVENTION

According to a first aspect of the invention, a method of controlling a wireless broadcast transmission of media data via multiple transmitter sites into a broadcast area with different inter-site distances is proposed, wherein the broadcast area comprises at least a region of large inter-site distance and a region of small inter-site distance, and wherein the method comprises the steps of initiating a first transmission into the broadcast area, the first transmission being adapted for reception in a first of the regions; and initiating a second transmission into a second of the regions, the second transmission being adapted for reception in the second region.

The regions of large inter-site distance and of small inter-site distance may be determined or defined in various ways, e.g. by an operator of a network comprising the broadcast area. Alternatively, transmitter sites may also determine their membership to a particular of the regions by detecting distances to their neighbouring sites. In case the detected distances fall on the average below a predetermined threshold value, the transmitter site determines itself to be in the region of small ISD, and in case the detected distances are on the average above the threshold value, the site falls into the region of large ISD. The threshold value may for example be dependent on atmospheric conditions or other parameters.

More than just two regions of different ISD may be defined; for example, three regions of large, intermediate and small inter-site distance may be defined, e.g. by defining intervals with respective upper and lower thresholds, with transmissions being specifically adapted for reception in any of these regions.

The adaptation to the regions of small and large inter-site distance, respectively, may comprise adjusting the transmission mode such that a predetermined bit or packet error rate will be achieved at a receiver located in the region. The transmission mode specifies at least the characteristics of radio resources utilized for transmitting the broadcast signal representing the media data. The transmission mode may for example specify the usage of time slots, frequency channels, transmit power and/or spreading codes.

The first transmission may be adapted for reception in the region of large inter-site distance and the second transmission may be accomplished into the region of small inter-site distance, the second transmission then being adapted for reception in the region of small inter-site distance. The first transmission may be used to provide a basic quality to the entire broadcast area, whereas the second transmission provides an enhanced quality to the region of small inter-site distance.

As an example, the media data may comprise hierarchically layered data with at least a base layer and an enhancement layer. The base layer provides a basic media presentation quality, and the enhancement layer adds further quality. The step of initiating the first transmission may then comprise initiating a transmission of the base layer and the step of initiating the second transmission may comprise initiating a transmission of the enhancement layer.

The method aspect of the invention discussed here may comprise the further steps of determining if transmission resources for a transmission of the enhancement layer are available at one or more transmitter sites of the region of large inter-site distance. In case of available transmission resources, a third transmission may be initiated via the one or more transmitter sites into the region of large inter-site distance. The third transmission may be adapted for reception of the enhancement layer in the region of large inter-site distance.

The available transmission resources for the third transmission may comprise resources usually used for unicast transmissions performed by the same transmitter sites. For example, in a mobile network, unicast and broadcast transmissions can be performed using the same antennas. In modern cellular networks it is possible to split the radio resources at a transmitter site as required for broadcast and unicast traffic, i.e. the splitting may be adjusted according to demand.

Although performed into the region of large ISD, the third transmission may alternatively also be adapted for reception in the region of small ISD. In this case the third transmission may extend the second transmission, which concerns the transmission of the enhancement layer into the region of small ISD, and being adapted to the region of small ISD, into the region of large ISD, but without adaptation to the region of large ISD. At least receivers nearby to a transmitter site in the region of large ISD will receive the enhancement layer. No additional radio transmission resources are required in this case of hierarchical modulation, in which the base layers and the enhancement layers are transmitted via the same radio transmission resource.

In the case, that the third transmission is adapted for reception in the region of large ISD, the enhancement layer is broadcasted into the entire service area at the expense of additional radio resources used in the region of large ISD (as compared to the transmission into the region of small ISD).

The second transmission may comprise transmitting a single representation of the media data and the third transmission may comprise transmitting multiple representations of the media data, in this way adapting the transmissions of the enhancement layer for to the region of small and large ISD, respectively.

Alternatively, the first method aspect discussed here may comprise the further steps of transmitting a subset of the media data of the enhancement layer via the second transmission, and transmitting the media data of the enhancement layer via the third transmission. For example, the method may comprise the steps of indicating in a bit stream associated with the media data of the enhancement layer bits that may be omitted in a transmission, transmitting the bit stream via the second transmission excluding the omitted bits and transmitting the bit stream via the third transmission including the omitted bits.

For instance, a common channel coding may be initiated for the media data of the enhancement layer for the second and the third transmission. Further, a puncturing of an encoded bit stream resulting from the common channel coding may be initiated. Then in the second transmission only the encoded bitstream excluding the punctured bits is transmitted into the region of small ISD, whereas in the third transmission the encoded bit stream including the punctured bits is transmitted into the region of large ISD. The third transmission may include the complete bitstream or only the punctured bits.

The transmitter sites of the broadcast area may perform the first transmission each utilizing one and the same frequency and/or time resource and may perform the further transmission(s) utilizing different frequency and/or time resources. For example, the transmission of the base layer may be performed according to the principles of an SFN, and the second transmission may be performed at different times or on different frequencies at neighbouring sites.

The method aspect of the invention discussed here may comprise that the first transmission (into the entire broadcast area) is adapted for reception in the region of small inter-site distance and the second transmission is accomplished into the region of large inter-site distance, the second transmission being adapted for reception in the region of large inter-site distance. Thus, the first transmission may not fully cover the region of large inter-site distance.

One and the same broadcast signal representing the media data may be transmitted in the first transmission and in the second transmission. The transmissions may however utilize different transmission resources, such that the second transmission into the region of large ISD utilizes more or additional transmission resources than the first transmission (i.e. compared to the resources utilized by the first transmission) for providing the media data with an acceptable quality into the region of large ISD.

As an example, the first transmission may comprise transmitting a single representation of the media data and the second transmission may comprise transmitting multiple representations of the media data. For instance, multiple copies of OFDM symbols may be transmitted in the second transmission using additional transmission resources, namely additional time slots and/or frequency (sub)channels.

As another example, the method may comprise the further steps of transmitting a subset of the media data of the enhancement layer via the first transmission, and transmitting the media data of the enhancement layer via the second transmission. The method may e.g. comprise the steps of indicating in a bit stream associated with the media data of the enhancement layer bits that may be omitted in a transmission, transmitting the bit stream via the first transmission excluding the omitted bits and transmitting the bit stream via the second transmission including the omitted bits.

For instance, the method may comprise the step of initiating a common channel coding for the media data for the first and the second transmission. Then, in the first transmission only a subset of the encoded media data may be transmitted, namely the encoded bitstream excluding the punctured bits, and in the second transmission, the remaining bits of the encoded data are transmitted, namely the punctured bits of the encoded bit stream. In the alternative, in the second transmission a bitstream including the punctured and the unpunctured bits may be transmitted.

According to a second aspect of the invention, a method of controlling a wireless broadcast transmission of media data via multiple transmitter sites into a broadcast area with different inter-site distances is proposed, wherein the broadcast area comprises at least a region of large inter-site distance and a region of small inter-site distance, and wherein the method comprises the steps of initiating a first transmission into a cell served by a transmitter site, the first transmission being adapted for reception in the region of large inter-site distance; and initiating a second transmission into the cell, the second transmission being adapted for reception in the region of small inter-site distance.

The transmitter at the transmitter site thus performs at least two transmissions. The transmitter may for example be located anywhere in the broadcast area and may transmit in the first transmission a base layer of hierarchically encoded media data and in the second transmission an enhancement layer. In another example, the transmitter may be located in the region of large inter-site distance and may transmit in the first transmission a subset of the media data sufficient for decoding the broadcast signal in the region of small ISD, and may transmit in the second transmission at least a portion of the remaining bits. In general, the first (second) transmission according to the second method aspect of the invention may coincide with the first (second) transmission of the first method aspect of the invention discussed further above, or may coincide with the second (first) transmission of the first method aspect of the invention.

According to a third aspect of the invention, a method of receiving a wireless broadcast transmission of media data via multiple transmitter sites into a broadcast area with different inter-site distances is proposed, wherein the broadcast area comprises at least a region of large inter-site distance and a region of small inter-site distance. The method comprises the steps of receiving a first transmission from at least one transmitter site, the first transmission being adapted for reception in the region of large inter-site distance; and receiving a second transmission from at least one transmitter site, the second transmission being adapted for reception in the region of small inter-site distance.

The media data may for example comprise hierarchically layered data with at least a base layer and an enhancement layer. Then the first transmission may comprise a transmission of the base layer and the second transmission may comprise a transmission of the enhancement layer. The transmissions may be received in the region of small inter-site distance. They may also be received in the region of large inter-site distance with acceptable reception quality close to a transmitter site.

Additionally or alternatively, one and the same broadcast signal representing the media data may be transmitted in the first transmission and in the second transmission, and the transmissions may utilize different transmission resources. For example, after a common channel encoding, the first transmission may transmit an encoded bit stream omitting punctured bits, whereas in the second transmission the punctured bits are transmitted.

According to another aspect of the invention, a computer program is proposed, the program comprising program code portions for performing the steps of any one of the method aspects discussed herein when the computer program is run on one or more computing devices. The computer program may be stored on a computer readable recording medium.

According to still another aspect of the invention, a broadcast control system for controlling a wireless broadcast transmission of media data via multiple transmitter sites into a broadcast area with different inter-site distances is proposed. The broadcast area comprises at least a region of large inter-site distance and a region of small inter-site distance. The system comprises at least one first transmission control component adapted for initiating a first transmission into the broadcast area, the first transmission being adapted for reception in a first of the regions; and at least one second transmission control component adapted for initiating a second transmission into a second of the regions, the second transmission being adapted for reception in the second of the regions. This broadcast control system may implement the steps of the first method aspect discussed further above.

One of the at least one first transmission control components may be adapted to initiate the first transmission which is adapted for reception in the region of large inter-site distance, and one of the at least one second transmission control components may be adapted to initiate the second transmission which is adapted for reception in the region of small inter-site distance.

Additionally or alternatively, one of the at least one first transmission control components may be adapted to initiate the first transmission, which is adapted for reception in the region of small inter-site distance and one of the at least one second transmission control components may be adapted to initiate the second transmission which is adapted for reception in the region of large inter-site distance. Such a transmitter may therefore be utilized flexibly for different transmission schemes within the framework of the invention.

The broadcast control system may further comprise a signalling component for initiating a transmission of control data related to the radio resources used for the first and second transmission into cells of the broadcast area covered by both transmissions. For example, the system may use a signalling channel for transmitting information related to the frame numbers and identifiers of resource blocks in the transmitted frames, to allow the receiver to recombine the broadcasted data received in the first and the further transmissions to eventually recover the media data.

According to a still further aspect of the invention, a transmitter for controlling a wireless broadcast transmission of media data into a broadcast area with different inter-site distances is proposed, wherein the broadcast area comprises at least a region of large inter-site distance and a region of small inter-site distance, and wherein the transmitter comprises a first transmission control component adapted for initiating a first transmission into a cell of the broadcast area served by the transmitter, the first transmission being adapted for reception In the region of large inter-site distance; and a second transmission control component adapted for initiating a second transmission into the cell, the second transmission being adapted for reception in the region of small inter-site distance. This transmitter may implement the second method aspect of the invention discussed further above.

According to another aspect of the invention, a radio access network (RAN) of a mobile network is proposed, comprising at least one of a broadcast control system and a transmission site as described herein. For example, it is possible to control a transmitter site or multiple transmitter sites by a control node in the RAN (or in a core network of the mobile network) to perform at least one of the first and second transmission. It is also possible to install control logic into some or all of the transmitter sites to enable them to autonomously decide on the required transmission(s) and transmission mode(s).

According to a further aspect of the invention, a receiver component for receiving a wireless broadcast transmission of media data via multiple transmitter sites into a broadcast area with different inter-site distances is provided, wherein the broadcast area comprises at least a region of large inter-site distance and a region of small inter-site distance, and wherein the receiver comprises a first interface adapted for receiving a first transmission from at least one of the transmitter sites, the first transmission being adapted for reception in the region of large inter-site distance; and a second interface adapted for receiving a second transmission from at least one of the transmitter sites, the second transmission being adapted for reception in the region of small inter-site distance. This receiver component may implement the steps of the third method aspect of the invention discussed further above.

According to a still further aspect of the invention, a user equipment for a mobile network is proposed, the user equipment comprising a receiver component according to the invention.

BRIEF DESCRIPTION OF THE DRAWINGS

In the following, the invention will further be described with reference to exemplary embodiments illustrated in the figures, in which.

DETAILED DESCRIPTION OF PREFERRED EMBODIMENTS

In the following description, for purposes of explanation and not limitation, specific details are set forth, such as specific network topologies including particular network nodes, transmission modes, etc., in order to provide a thorough understanding of the current invention. It will be apparent to one skilled in the art that the current invention may be practised in other embodiments that depart from these specific details. For example, the skilled artisan will appreciate that the current invention may be practised with broadcast services different from the GSM or UMTS broadcast services discussed below to illustrate the present invention. The invention may be practised in any network enabled for wireless broadcast or, more generally, point-to-multipoint transmissions. For example, the invention may be applicable—besides mobile networks—to (additionally or alternatively) WLAN, Bluetooth or similar wireless networks, and also to mobile or wireless networks which may be developed in the future.

Those skilled in the art will further appreciate that functions explained hereinbelow may be implemented using individual hardware circuitry, using software or firmware functioning in conjunction with a programmed microprocessor or a general purpose computer, using an application specific integrated circuit (ASIC) and/or using one or more digital signal processors (DSPs). It will also be appreciated that when the current invention is described as a method, it may also be embodied in a computer processor and a memory coupled to a processor, wherein the memory is encoded with one or more programs that perform the methods disclosed herein when executed by the processor.

The term 'interface' as used herein comprises 'functional interfaces'. A functional interface designates a sub-structure contained within a functional component or structure (a hardware, firmware and/or software component or functional entity) intended for communication with other, external components or structures. A functional interface may be purely software-implemented, for example if the structure, for which the functional interface provides the interfacing functionality, is a software component.

Figure 1:
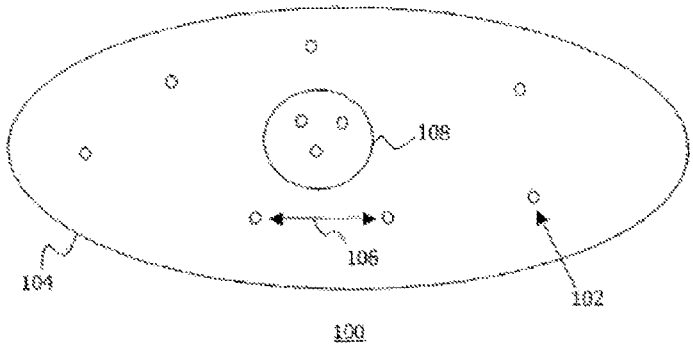
FIG. 1 is a schematic illustration of an embodiment of a broadcast area comprising multiple transmitter sites with different inter-site distances.

FIG. 1 schematically illustrates an embodiment 100 of a broadcast area comprising multiple transmitter sites 102 for wireless broadcast transmission of media data. The transmitter sites 102 may belong to a PLMN (not shown) and may in principle enable a complete coverage of the geographical area given by the broadcast area 100 provided that appropriate transmission modes are chosen.

The broadcast area 100 comprises a region 104, wherein the distance between neighbouring pairs of transmitter sites 102 (the inter-site distance ISD 106) is large, i.e. the ISD 106 is larger than a predetermined distance value, which may be configured by the operator of the transmitters 102. The threshold distance value may for example be of the order of one kilometer or several kilometers. The broadcast area 100 further comprises a region 108, wherein the ISD is smaller than the threshold distance value. The region of small ISD 108 may coincide for example with a city or the central part of a city, whereas the region of large ISD 104 may coincide with a rural area. In other embodiments, instead of just two types of regions, several types of regions may be defined, for example regions of small, intermediate and large ISD. The broadcast transmission of media data will be specifically adapted to the regions of different ISDs, as will be described in detail in the following.

Figure 2:
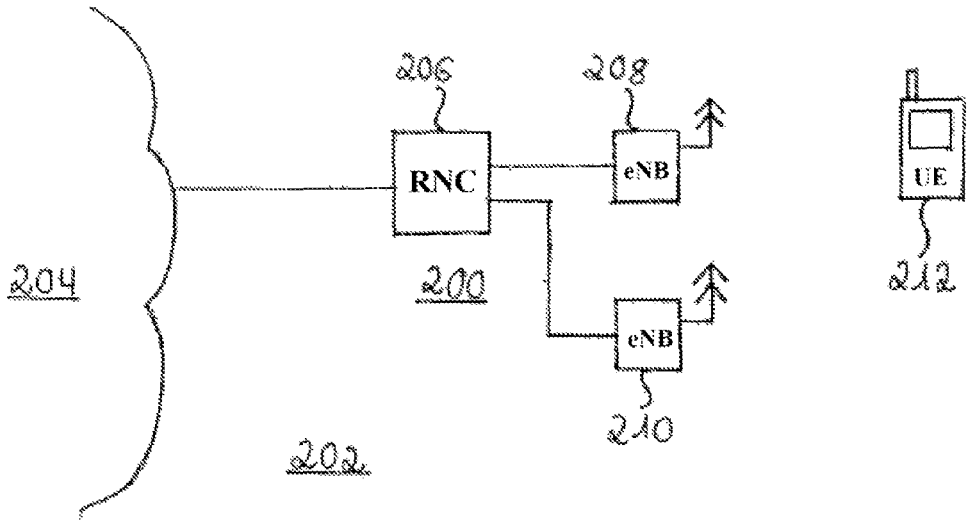
FIG. 2 is a schematic illustration of an embodiment of a radio access network (RAN)

FIG. 2 illustrates an embodiment 200 of a radio access network (RAN) of a mobile network 202. The network 202 further comprises a core network 204. Media data for wireless broadcast transmissions are received from the core network 204 by a radio network controller (RNC) 206. The RNC 206 controls Node-Bs 208 and 210, in the following also generally referred to as transmitter sites 208, 210. The transmitter sites 208, 210 may be realizations of the transmitter sites 102 of FIG. 1. RNC 206 may operate the transmitters 208, 210 in SFN-mode, i.e. the sites 208, 210 synchronously transmit the media data into the broadcast area (not shown in FIG. 2). The broadcasted media data are received by a user equipment 212, which is located close to the transmitter sites 208, 210.

A broadcast control system for controlling a wireless broadcast transmission of media data via multiple transmitter sites into a broadcast area with different inter-site distances may be implemented in the RAN 200, namely in at least one of the RNC 206 and one or more of the transmitter sites 208, 210. The system may also be implemented in a control node (not shown) in the core network 204. Still further, the broadcast control system may be distributed over nodes of the RAN 200 and/or the core network 204.

Figure 3A:
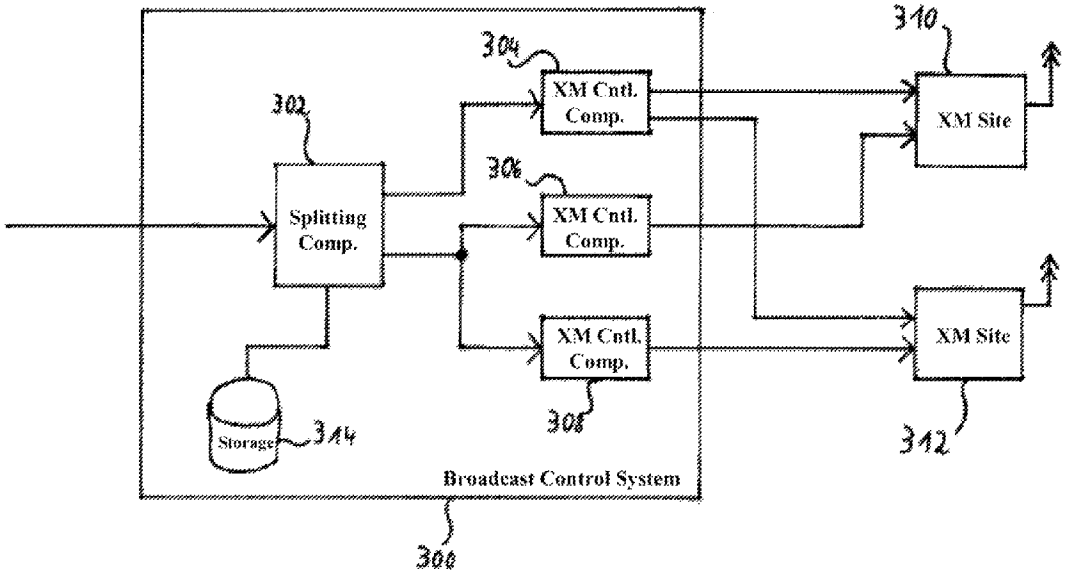
FIG. 3A is a functional block diagram illustrating a first embodiment of a broadcast control system implemented in an RNC.

FIG. 3A schematically illustrates an embodiment 300 of a broadcast control system. The system 300 may be implemented in the RNC 206 of FIG. 2, or may alternatively be implemented, for example, in a BSC of a GSM RAN. The system 300 receives media data via a splitting component 302. The data are forwarded to first, second, and third transmission control components 304, 306 and 308. After appropriate processing, the media data are forwarded to transmitter sites 310 and 312, which may be constituted by the sites 208, 210 discussed above with reference to FIG. 2.

Triggered by reception of the media data, the splitting component 302 retrieves from a storage 314 information about the further components of the broadcast control system to which to forward the media data. The RNC 300 controls the two transmitter sites 310, 312. Therefore, the component 302 forwards the received media data to the three transmission control components 304, 306, 308 associated with the sites 310, 312. The transmission control components 304 to 308 may serve further transmitter sites, and the RNC 300 may have further transmission control components, for example for further broadcast transmissions.

The splitting component 302 operates to split or separate a multi-layer media data stream into one or more base layers and one or more enhancement layers. The component 302 then forwards the base layer to the transmission control component 304 and the enhancement layer to the transmission control components 306 and 308.

The transmission control components further process the media data for preparing first, second and third transmissions of the data via the associated transmitter sites. It is assumed that transmitter sites 310 and 312 are located in different regions of the broadcast area: The site 310 is located in the region 108 of small ISD and the site 312 is located in the region 104 of large ISD. The first control component 304 operates to prepare the media data for the first transmission, i.e. the appropriate transmission mode for the first transmission. The first transmission is performed into the entire broadcast area, therefore the transmission control component 304 forwards the processed data to both transmitter stations 310 and 312. The component 304 operates to prepare the base layer media data received from the splitting component 302 for a transmission adapted for reception in the region of large ISD.

The second transmission control component 306 operates to prepare the media data for the second transmission, i.e. the appropriate transmission mode for the second transmission. As the transmitter station 310 is located in the region 108 of small ISD, the control component 306 prepares the enhancement layer media data for a transmission into the region 108 of small ISD (and adapted for reception in the region of small ISD).

The third transmission control component 308 receives the same enhancement layer media data from the splitting component 302 as the component 306 and operates to prepare the forwarded enhancement layer media data for a third transmission, which is performed into the region of large ISD. The control component 308 processes the data received from the component 302 to prepare a transmission of the data specifically adapted for reception in the region of large ISD.

In another embodiment, a puncturing component (not shown in FIG. 3A) may be arranged between the splitting component 302 and the transmission control components 306, 308. Such a puncturing component may output a bitstream omitting the punctured bits to the control component 306 for the second transmission into the region of small ISD, and may further output a bitstream including the punctured bits to the control component 308 for the third transmission into the region of large ISD.

Figure 3B:
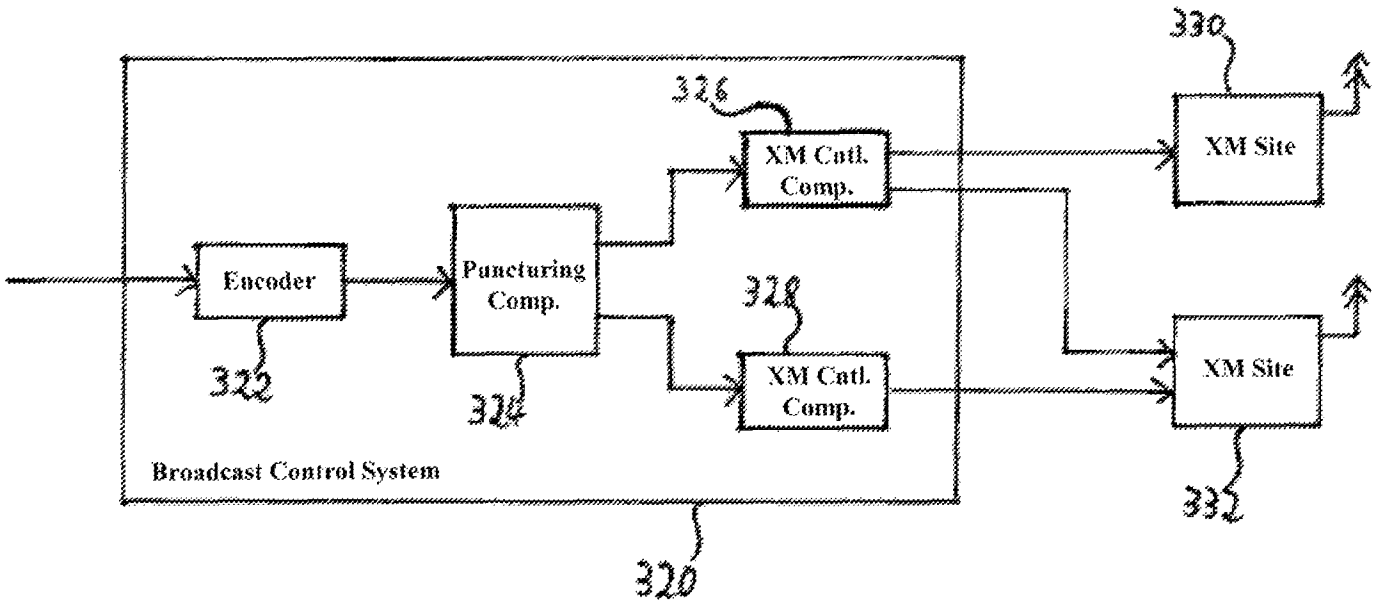
FIG. 3B is a functional block diagram illustrating a second embodiment of a broadcast control system implemented in an RNC.

FIG. 3B schematically illustrates another embodiment 320 of a broadcast control system. The system 320 may also be implemented in the RNC 206 of FIG. 2, or may alternatively be implemented, for example, in a BSC of a GSM RAN. The system 320 receives media data at an encoding component 322. Encoded data are forwarded to a puncturing component 324, which forwards the data to a first and a second transmission control component 326 and 328. After appropriate processing, the media data are forwarded to transmitter sites 330 and 332, which may be constituted by the sites 208, 210 discussed above with reference to FIG. 2.

The encoding component 322 performs a common channel coding of the received media data for both, the first and the second transmission. The component 322 then forwards the encoded data stream to the puncturing component 324. The component 324 identifies bits (puncture bits) of the received bit stream, which may be omitted in the transmission into the region of small ISD. The puncturing component then splits the bit stream into a first bitstream, which does not contain the punctured bits anymore, and a second bitstream, which does only contain the punctured bits. The component 324 forwards the first stream to the first transmission control component 326 and the second bitstream to the second transmission control component 328.

The transmission control components 326, 328 further process the received bit streams for preparing a first and a second transmission via the associated transmitter sites. It is assumed that transmitter sites 330 and 332 are located in different regions of the broadcast area: The site 330 is located in the region 108 of small ISD and the site 332 is located in the region 104 of large ISD. The first control component 326 prepares the appropriate transmission mode for the first transmission, which is performed into the entire broadcast area. Therefore the transmission control component 326 forwards the processed data to both transmitter stations 330 and 332.

The second transmission control component 328 receives the bit stream containing the punctured bits and prepares the appropriate transmission mode for the second transmission into the region of large ISD, i.e. via the transmitter site 332. The transmitter site 332 therefore transmits the first and the second bitstream.

Figure 3C:
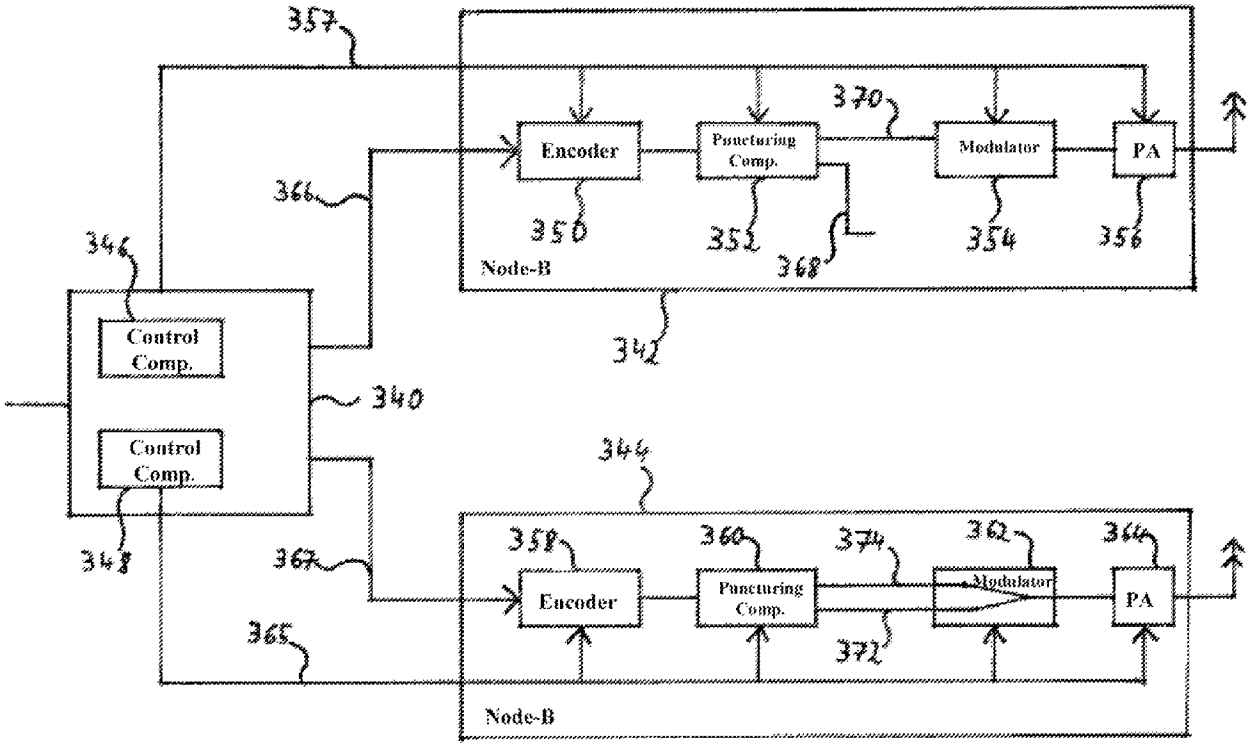
FIG. 3C is a functional block diagram illustrating an embodiment of a broadcast control system implemented in an RNC and Node-Bs.

FIG. 3C schematically illustrates an embodiment of a broadcast control system which is implemented distributed over an RNC 340 and Node-Bs 342, 344. The RNC 340 ma be an embodiment of the RNC 206 of FIG. 2, and the Node-Bs 342, 344 may be an embodiment of the Node-Bs 208, 210 of FIG. 2. The RNC 340 comprises two controller components 346 and 348 for controlling transmission of media data in the Node-Bs 342 and 344, respectively. The controller components 346, 348 may incorporate control functionalities similar to the transmission control components of FIGS. 3A, 3B.

The Node-B 342 comprises an encoding component 350, a puncturing component 352, a modulator 354 and a power amplifier 356. The components 350, 352, 354 and 356 in the Node-B 342 are controlled by the controller component 346 of RNC 340 via signalling communications 357. The Node-B 344 comprises an encoding component 358, a puncturing component 360, a modulator 362 and a power amplifier 364. The components 358, 360, 362 and 364 in the Node-B 344 are controlled by the controller component 348 of RNC 340 via signalling communications 365.

The media data to be transmitted comprise a single-layer data stream which is forwarded by the RNC 340 in data communications 366 and 367 via the Iub interface known to the skilled person to the Node-Bs 342, 344. It is assumed that the Node-B 342 is located in a region of small ISD. The component 350 performs a channel encoding for the media data received from the RNC 340 and forwards the encoded data to the puncturing component 352. The puncturing component punctures the encoded bit stream. A bit stream 368 comprising the punctured bits is not used for transmission, as illustrated in FIG. 3C by the loose end of the stream 368. A bit stream 370 comprising the unpunctured bits is forwarded to the modulator 354, which finally modulates the broadcast signal, and the amplifier 356 for transmission of the unpunctured bits only into the region of small ISD.

The Node-B 344 is located in a region of large ISD. The component 358 performs a channel encoding for the media data received from the RNC 340 and forwards the encoded data to the puncturing component 352. The puncturing component punctures the encoded bit stream and forwards a bit stream 372 comprising the punctured bits and a bit stream 374 comprising the unpunctured bits to the modulator 362. The modulator 362 modulates the broadcast signal comprising the bitstreams 372 and 374 and forwards the signal to the amplifier 364 for transmission of both the punctured and the unpunctured bits into the region of large ISD.

In other embodiments, the transmission control components (controller components) or multiple implementations thereof may be implemented in a node of the core network. In still other embodiments, the preprocessing components or controller components may also be located in a dedicated network node.

Figure 4:
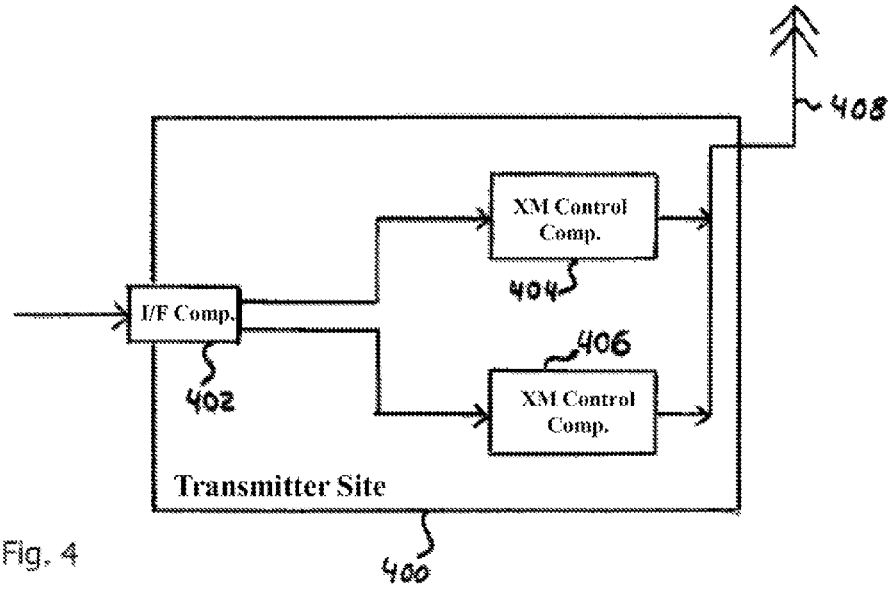
FIG. 4 is a functional block diagram illustrating an embodiment of a broadcast control system implemented in a transmitter site.

FIG. 4 illustrates an embodiment 400 of a broadcast control system implemented in a transmitter site. The transmitter site 400 may be a BTS of a GSM-RAN or a Node-B of a UMTS-RAN. For example, the transmitter site 400 may be one of the sites 102 of FIG. 1 or one of the sites 208, 210 of FIG. 2. In the following, it is exemplarily assumed that the transmitter site 400 is an embodiment of the transmission site (Node-B) 208 of FIG. 2.

The transmitter site 400 comprises an interface component 402 for receiving media data from the RNC 206 in RAN 202, which may forward the media data without processing. The interface component 402 forwards the received media data to first and second transmission control components 404 and 406. The first component 404 is adapted for initiating a first transmission into a cell of the broadcast area 100 (see FIG. 1) served by the transmitter. The second transmission control component 406 is adapted for initiating a second transmission into the cell. The second transmission may be adapted for reception in the region 108 of small ISD or the region 104 of large ISD. The initiation may comprise preparing the media data for the transmissions (channel coding, associating the media data to transmission frames, associating the frames to particular time slots and/or frequency channels, determining the transmission power, etc.) and forwarding the processed data, i.e. the broadcast data, to the antenna 408 for transmission into the cell.

In other embodiments, the interface component may also comprise preprocessing modules similar to the components 302, 322, 324 in FIGS. 3A, 3B. The interface component segregating the media data stream for the two transmission control components may also be located external to the transmitter site, for example in an RNC or BSC of the RAN. Further, a transmitter site may comprise only one of the two transmission control components illustrated in FIG. 4. For example, the first transmission control component for preparing the first transmission may be located upstream in the RAN (or even the core network) and provide its data output to multiple transmitter sites, as the first transmission is performed into the entire broadcast area.

Figure 5:
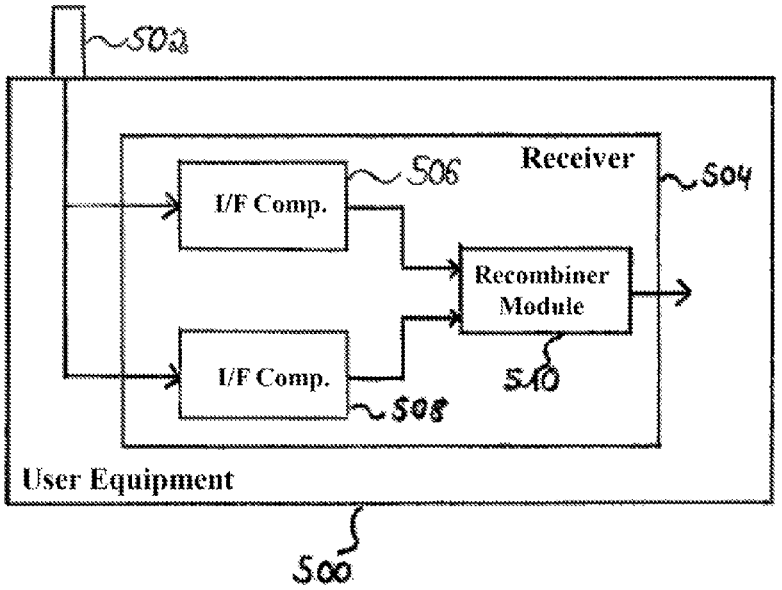
FIG. 5 is a functional block diagram illustrating an embodiment of a receiver component implemented in a user equipment.

FIG. 5 schematically illustrates the functional components of an embodiment 500 of a user equipment for use with a mobile network, for example the network providing the broadcast area 100 of FIG. 1 or the network 202, 204 of FIG. 2.

The user equipment 500 comprises an antenna 502 and a receiver component 504. The receiver component 504 may forward received media data to further components of the UE 500 (not shown), for example presentation components for presenting the media data on a display associated with the UE 500. The antenna 502 and/or the receiver 504 may comprise filter components for filtering the received broadcast signal, which are also omitted in FIG. 5 for clarity.

The receiver stage 504 contains a first interface component 506 for receiving a first broadcast transmission and a second interface component 508 for receiving a second broadcast transmission, both transmissions typically using different transmission resources. One of the transmissions is adapted for a region of small ISD of the broadcast area, the other transmission is adapted for a region of large ISD of the broadcast area.

Both interface components 506, 508 may comprise modules for recovering media data from the received broadcast signal. The modules may extract broadcast data from received transmission frames and may perform channel decoding and functions for recovering a bit stream from broadcast data received in different time slots and/or frequency sub-channels. A further module 510 is provided for recombining a single media stream, for example in case a first transmission transmits a base layer of multi-layered media data and a second transmission transmits an enhancement layer of the media data. The module 510 may be omitted in the receiver stage 504 in case a presentation component is able to combine the base layer and the enhancement layer.

Figure 6:
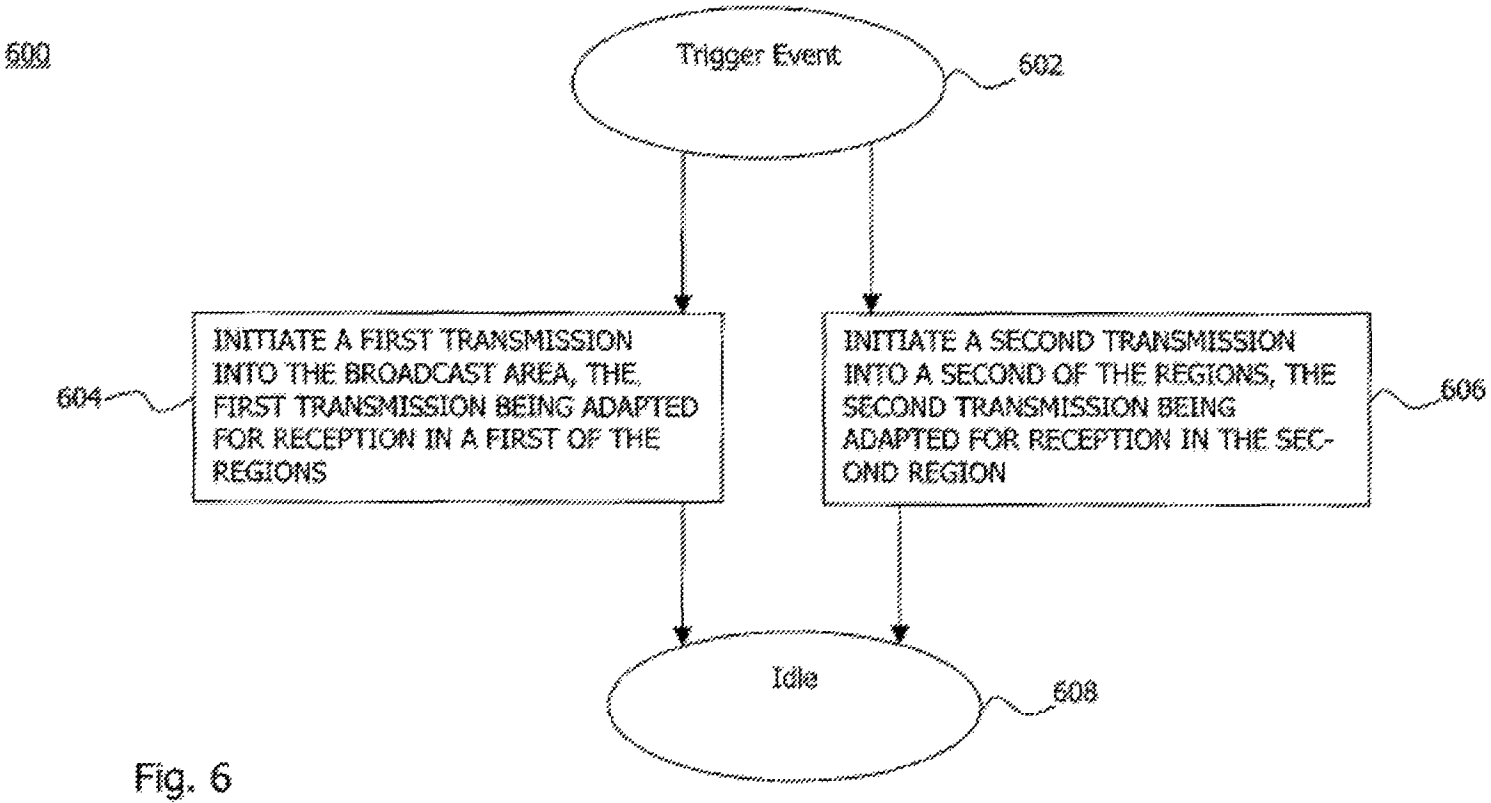
FIG. 6 is a flowchart illustrating a first method embodiment for controlling a wireless broadcast transmission of media data via multiple transmitter sites into a broadcast area with different inter-site distances.

FIG. 6 is a flow chart which illustrates the steps of an embodiment 600 of a method of controlling a wireless broadcast transmission of media data via multiple transmitter sites into a broadcast area with different inter-site distances. The broadcast area comprises at least a region of large ISD and a region of small ISD. The method 600 may be implemented in one or more network nodes of a broadcast-enabled network, for example the RNC 206 or the transmitter sites 208, 210 of FIG. 2. In the following, it is exemplarily assumed that the method 600 is performed in the RNC-based broadcast control system 300 of FIG. 3A.

Execution of the method 600 is triggered in step 602 by a triggering event, for example the reception of media data intended for broadcast transmission at the splitting component 302 of the broadcast control system 300. The reception of the data triggers step 604, in which a first transmission is initiated into the broadcast area, the first transmission being adapted for reception in a first one of the two regions. The trigger event 602 further triggers step 606, in which a second transmission into the second one of the regions is initiated, the second transmission being adapted for reception in the second region. The method stops in step 608, when for example the broadcast control system 300 waits for further broadcast data to be transmitted.

It is to be understood that steps 604 and 606 may be performed simultaneously. Alternatively, steps 604 and 606 may be performed sequentially, such that the radio resources of a particular transmitter site are utilized in a first time step for the first transmission and in a subsequent time step for the second transmission.

Figure 7:
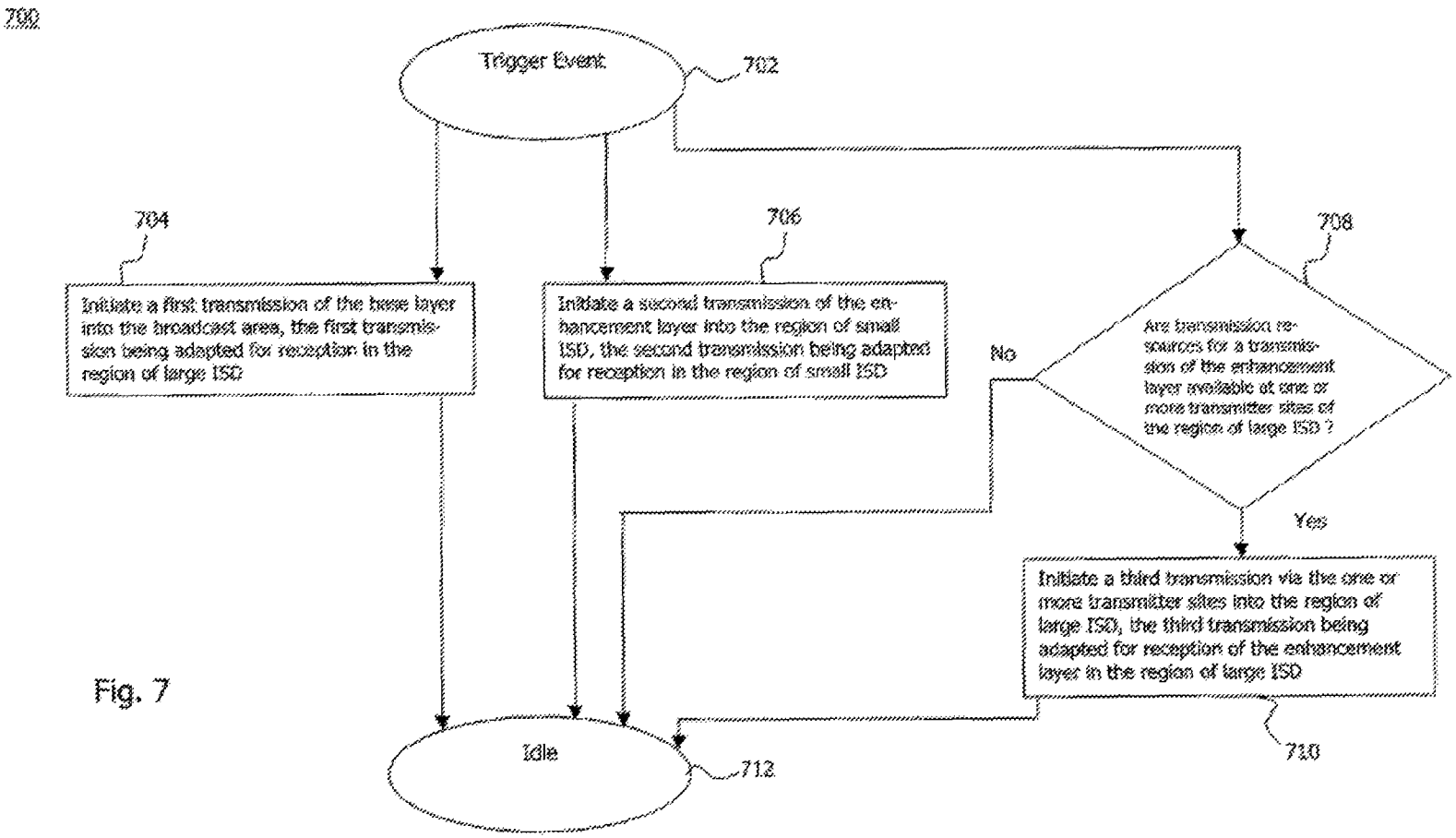
FIG. 7 is a flowchart illustrating a second method embodiment for controlling a wireless broadcast transmission.

FIG. 7 is a flow chart which illustrates the steps of a further embodiment 700 of a method of controlling a wireless broadcast transmission of media data via multiple transmitter sites into a broadcast area with different inter-site distances. Step 702 triggers execution of steps 704, 706 and 708. For the embodiment 700 it is assumed that the media data comprise hierarchically layered data with a base layer and an enhancement layer. The media data may be hierarchically coded at a media server providing the media data or in the core network 204 (see FIG. 2).

The steps 704, 706 and 708 may for example be performed by the transmission control components 304, 306 and 308, respectively, of the broadcast control system 300 in FIG. 3A. The preprocessing (splitting) component 302 of the system 300 may act to split the multiple layer media data stream into base layer and enhancement layer, and may forward only the base layer data stream to the control component 304 and only the enhancement layer data stream to the control components 306 and 308.

The step 704 is related to a transmission of the base layer and the steps 706, 708 are related to a transmission of the enhancement layer. In step 704, a first transmission of the base layer is initiated into the entire broadcast area. The first transmission is adapted for reception in the region of large ISD. In step 706, a second transmission, namely a transmission of the enhancement layer, is initiated into the region of small ISD. The second transmission is adapted for reception in this region.

In step 708 it is determined if transmission resources for a transmission of the enhancement layer are available at one or more transmitter sites of the region of large ISD. In case of available resources, in step 710 (at least) a third transmission is initiated via the one or more transmitter sites into the region of large ISD. The third transmission is adapted for reception of the enhancement layer in the region of large ISD. Thus, the enhancement layer is available for reception not only in the region of small ISD, but also in the region of large ISD in case of available radio resources.

In particular embodiments, only for step 704 of the first transmission of the base layer into the entire broadcast area an SFN transmission mode may be used, whereas for the second and optionally third transmission of the enhancement layer (steps 706, 708) each transmitter site uses a frequency different from the frequencies used by the neighbouring stations.

In other embodiments, a multimedia stream may comprise several base layers and/or several enhancement layers. Generally the base layer or layers provide a basic media presentation quality. The additional reception of the one or more enhancement layer(s) increases the presentation quality compared to the quality provided by the base layer.

The base layer is transmitted into the entire broadcast area and is adapted for reception in the region of large ISD in step 704. More specifically, this means that the transmission mode of the base layer in terms of usage of time and/or frequency resources, transmission power and channel coding provides for a broadcast signal that can be successfully decoded in the entire broadcast area, i.e. in the region of small ISD and in the region of large ISD. This robust transmission mode does not achieve the theoretically possible throughput in the region of small ISD. However, in the embodiment 700 only the base layer is transmitted in this transmission mode. The second (third) transmission of the enhancement layer is specifically adapted to the region of small (large) ISD, leading to a better overall resource usage.

For transmitting the enhancement layer in step 706 in the second transmission into the region of small ISD, particular radio resources are utilized such that the desired coverage in the region of small ISD is achieved. As an example, hierarchical modulation may be used, in which the I-Q modulation constellation of an enhancement layer is superimposed to the constellation of the base layer, such that the layers modulate the same time-frequency resource blocks. In other embodiments, the enhancement layer and the base layer may be time and/or frequency multiplexed on different resource blocks.

The third transmission of the enhancement layer into the region of large ISD uses more radio resources than the second transmission of the enhancement layer into the region of small ISD. As an example, in the second transmission the enhancement layer may be transmitted using 64 QAM modulation and in the third transmission the enhancement layer may be transmitted using 16 QAM modulation (16 QAM is a more robust modulation scheme than 64 QAM). Using the same transmission resources, 16 QAM has a data rate 2/3 the data rate of a 64 QAM modulated transmission. Therefore a 16 QAM modulation used for the third transmission into the region of large ISD will require 50% more radio resources in the time and/or frequency domain than the second transmission into the region of small ISD.

Figure 8:
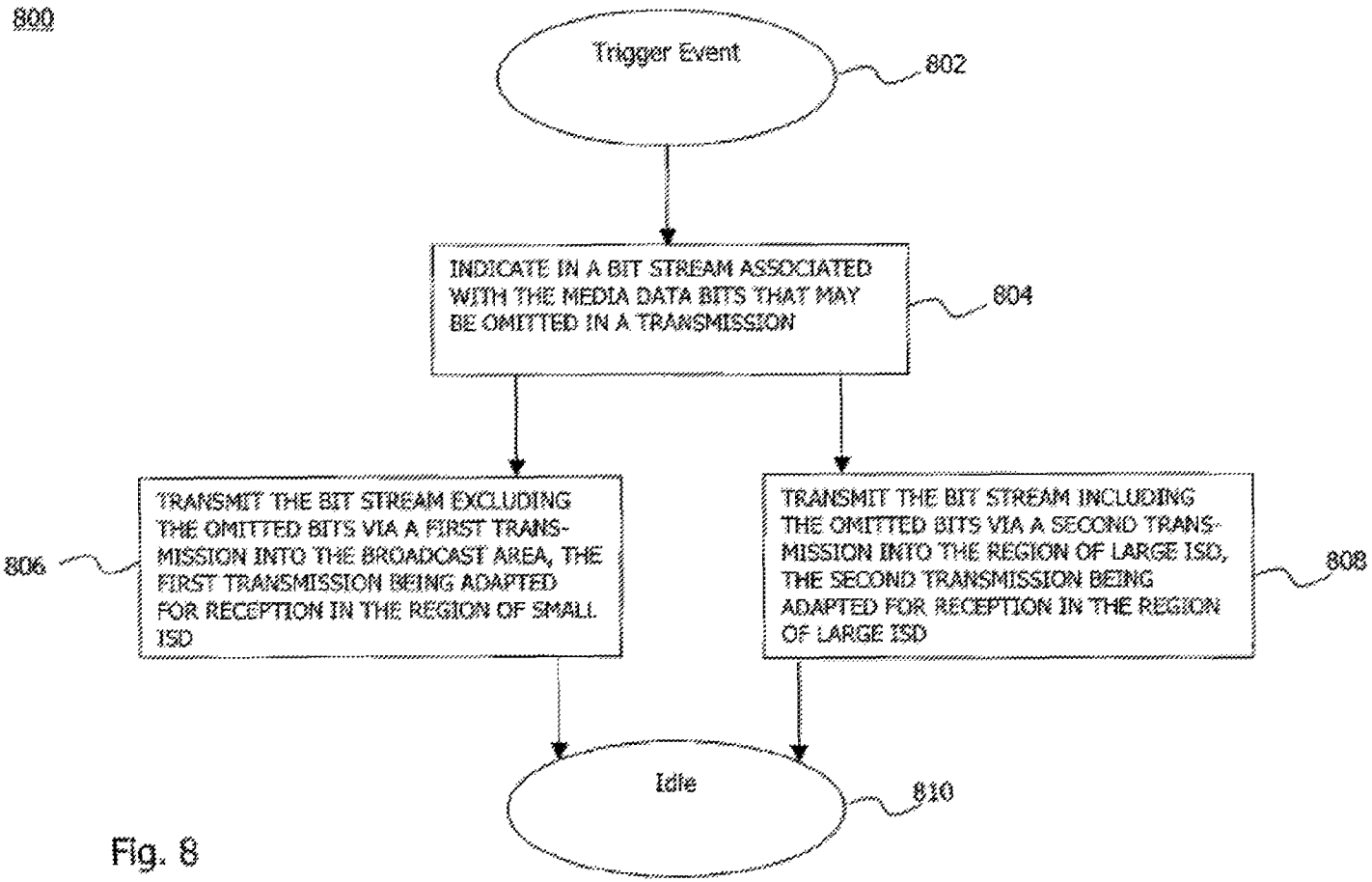
FIG. 8 is a flowchart illustrating a third method embodiment for controlling a wireless broadcast transmission.

FIG. 8 is a flow chart illustrating the steps of another embodiment 800 of a method of controlling a wireless broadcast transmission of media data via multiple transmitter sites into a broadcast area with different inter-site distances. The method will exemplarily be illustrated with reference to the embodiment of a broadcast control system implemented in an RNC and Node-Bs in FIG. 3C.

The method is triggered in step 802, for example by the reception of media data at the RNC 340. In step 804, in a bit stream associated with the media data bits are indicated that may be omitted in a transmission. This step may comprise a common channel coding of the media data to be broadcasted, which is performed by the encoding components 350, 358 and puncturing performed in the components 352, 360. In step 806, a first transmission into the broadcast area is initiated. The first transmission is adapted for reception in the region of small ISD. The bit stream excluding the omitted bits is transmitted into the broadcast area. In a parallel step 808, a second transmission of the same encoded broadcast signal is initiated into the region of large ISD. The second transmission is adapted for reception in the region of large ISD. The bit stream including the omitted bits is transmitted.

The first and second transmissions are initiated by the first and second transmitter sites 342 and 344, respectively. The transmitter site 342 may belong to the region of small ISD, whereas the site 344 belongs to the region of large ISD. In step 810, the broadcast control systems stops operation and waits for another triggering event.

The channel encoding in step 804 may comprise to apply for example a channel code with rate 1/3. Channel encoding might comprise convolutional or turbo coding. The output stream of the channel encoder might then be punctured, i.e. encoded bits may be suppressed from transmission by puncturing. The punctured streams may be output as sub-streams excluding/including the punctured bits at the puncturing components 352 and/or 352.

Accordingly, in step 806, only a sub-set of the encoded broadcast signal is transmitted, i.e. punctured bits are omitted from the first transmission into the broadcast area. This is possible, as with the comparatively good reception conditions in the region of small ISD, not all of the encoded bits are required in order to decode a received broadcast signal in good quality. The punctured bits are only transmitted in step 808 into the region of large ISD, as the punctured bit stream (which can be received in the region of large ISD via the first transmission) is not sufficient to decode the media data with the desired coverage in the region of large ISD.

Therefore, whereas the same media data are transmitted into the regions of small and large ISD, the radio resources used for the transmissions differ. The additional radio resources required in step 808 may comprise additional symbols (e.g. OFDM symbols) or additional sub-carriers. Systematic bits (or bits of different importance for successful decoding) may not be omitted from transmission, as these bits are required for any successful decoding.

A receiver located in the region of small ISD only requires the first transmission. A receiver located in the region of large ISD may require the first and the second transmission. The receiver may combine the bits transmitted via both transmissions prior to decoding.

In an alternative embodiment, redundancy is added to the broadcast signal for the region of large ISD by transmitting multiple representations or copies of the media data. The same channel coded information may thus be transmitted using multiple radio resource blocks, defined by at least one of time intervals and frequency channels. As an example, the encoded broadcast signal may be transmitted in multiple OFDM symbols, i.e. multiple copies in the time domain. In the alternative, the same information may be transmitted via multiple sets of OFDM sub-carriers (multiple copies in the frequency domain).

Figure 9:
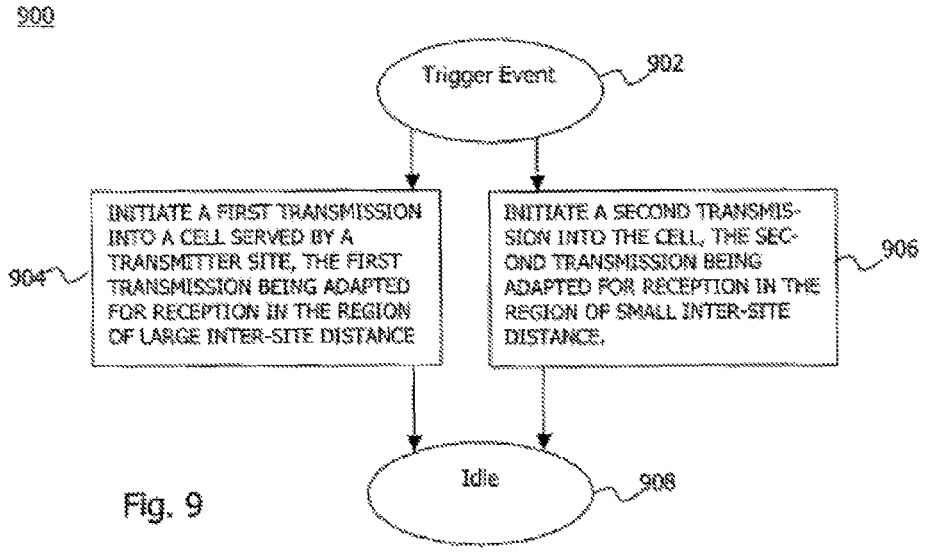
FIG. 9 is a flowchart illustrating a fourth method embodiment for controlling a wireless broadcast transmission.

FIG. 9 is a flow chart illustrating a still further embodiment 900 of a method of controlling a wireless broadcast transmission of media data via multiple transmitter sites into a broadcast area with different inter-site distances, wherein the broadcast area comprises at least a region of large ISD and a region of small ISD. The method describes the operation of a broadcast control system implemented in a transmitter site, for example in the transmitter site 400 of FIG. 4.

In step 902, the transmitter site is triggered, e.g., by the reception of media data intended for wireless broadcast transmission. In step 904, a first transmission is initiated into a cell served by the transmitter site. The first transmission is adapted for reception In the region of large ISD. in the parallel step 906, a second transmission is initiated into the cell. The second transmission is adapted for reception in the region of small ISD of the broadcast area. In step 908, the method 900 ends and waits for a new triggering event.

As an example, the transmitter may be located anywhere in the broadcast area and the first transmission may comprise the transmission of a base layer and the second transmission may comprise the transmission of an enhanced layer of multi-layer media data (the location of the transmitter in the region of large ISD or small ISD determines the particular radio resources utilized). As another example, the transmitter may be located in the region of large ISD and the second transmission may comprise the transmission of a broadcast signal utilizing radio resources, which are only sufficient for coverage in the region of small ISD and nearby the transmitter sites in the region of large ISD. The first transmission utilizes additional radio resources to achieve complete coverage also in the region of large ISD.

Figure 10:
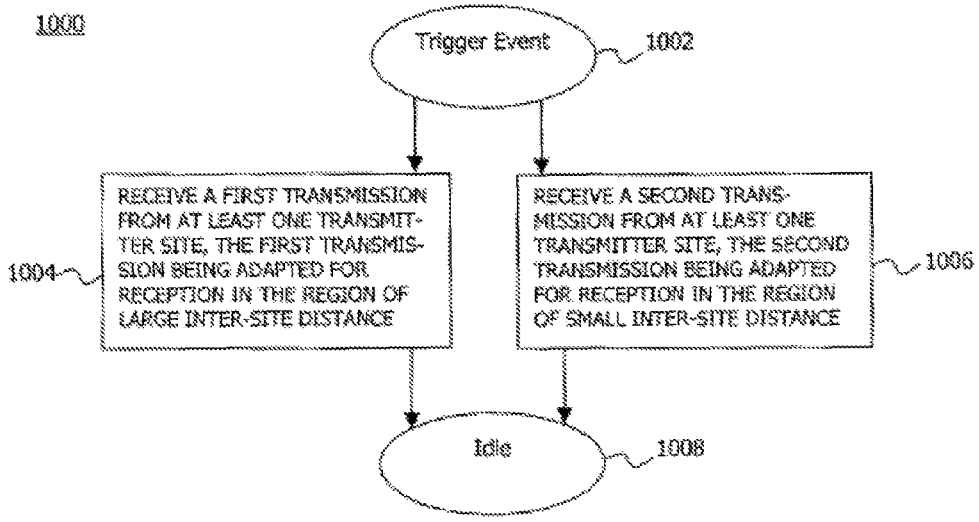
FIG. 10 is a flowchart illustrating a method embodiment for receiving a wireless broadcast transmission of media data via multiple transmitter sites into a broadcast area with different inter-site distances.

FIG. 10 is a flow chart illustrating an embodiment 1000 of a method for receiving a wireless broadcast transmission of media data via multiple transmitter sites into a broadcast area with different inter-site distances. Again, the broadcast area comprises at least a region of large ISD and a region of small ISD. The method 1000 is exemplarily discussed with reference to the embodiment 500 of a user equipment with a receiver component 504 in FIG. 5.

In step 1002, the receiver is triggered, for example, by the reception of broadcast data via antenna 502. In step 1004 a first transmission is received from at least one transmitter site. The first transmission is adapted for reception in the region of large ISD. In a parallel step 1006, a second transmission is received from at least one of the transmission sites. The second transmission is adapted for reception in the region of small ISD.

Several neighbouring transmitter sites may synchronously transmit the first and/or the second transmission. The receiver may thus receive the first and the second transmission from different sets of transmitter sites. For example, in case the receiver is located in a border zone between the region of large ISD and the region of small ISD, the receiver may receive a first transmission, which is transmitted from all transmitters in the broadcast area, whereas a second transmission is only transmitted by transmitter sites in the region of small ISD.

For all embodiments, it is to be noted that in addition to transmitting media data, also signalling data might be broadcasted into the broadcast area to indicate the utilized radio resources for the first, second and possibly third transmission. For example, an existing signalling channel according to a signalling framework of a mobile network may be used for this purpose. As an example, the multicast control channel (MCCH) in a UMTS system may be used. The signalling data may also indicate information on the media data and its properties.

Only signalling data may be broadcasted into a particular region which are required by the receivers located therein. For example, in case only a base layer of layered media data is transmitted into a region of large ISD, signalling information regarding the second transmission into the region of small ISD may be omitted from transmission into the region of large ISD. Part or all of the signalling data may be deduced by the receiver (blind detection) at the cost of adding complexity to the receiver.

The technique described above improves the spectral efficiency for single frequency networks in regions of small ISD, such that the broadcast throughput may be increased in these regions without reducing the coverage in the regions of large ISD in an unacceptable way. The technique further flexibly improves broadcast quality in regions of large ISD by using additional transmission resources in case such resources are available if these are, for example, temporarily not required for unicast transmissions.

In comparison to just increasing the transmission power for a particular resource block, adding additional radio resources in the time and/or frequency domain distributes the power spectral density more equally over the resource blocks in the time and frequency domain. Also, adding additional resource blocks gains from time or frequency diversity, e.g. reduces the error rate caused by short-term or narrow-band noise and fast fading. Performing a common channel coding for the first and second transmissions and transmitting the punctured bits only in the second transmission achieves a gain also in interference limited cells. Further, this mechanism acts to increase the transmission bandwidth by a factor which is equal to the number of added resource blocks instead of just increasing the signal to noise ratio by that factor.

While the current invention has been described in relation to its preferred embodiments, it is to be understood that this description is intended for illustrative, non-limiting purposes only. The invention shall be limited only by the scope of the claims appended hereto.

The invention claimed is:

1. A method of controlling a wireless broadcast transmission of media data via multiple transmitter sites into a broadcast area with different transmitter inter-site distances, wherein the method comprises the steps of:

determining a region of large transmitter inter-site distance and a region of small transmitter inter-site distance based on a distance threshold between the multiple transmitter sites in the broadcast area;

initiating a first transmission of the media data to a first transmitter site in the region of large transmitter inter-site distance; and initiating a second transmission of the media data of different quality to a second transmitter site in the region of small transmitter inter-site distance.

2. The method according to claim 1, wherein the media data comprise hierarchically layered data with at least a base layer and an enhancement layer, and wherein the step of initiating the first transmission comprises initiating a transmission of the base layer and the step of initiating the second transmission comprises initiating a transmission of the enhancement layer.

3. The method according to claim 2, comprising the further step of determining if transmission resources for a transmission of the enhancement layer are available at the first transmitter site in the region of large transmitter inter-site distance, and in case of available transmission resources, initiating a third transmission to the first transmitter site in the region of large transmitter inter-site distance.

4. The method according to claim 3, wherein the second transmission comprises transmitting a single representation of the media data and the third transmission comprises transmitting multiple representations of the media data.

5. The method according to claim 3, comprising the further steps of:

transmitting a subset of the media data of the enhancement layer via the second transmission, and transmitting the media data of the enhancement layer via the third transmission.

6. The method according to claim 5, comprising the further steps of:

indicating in a bit stream associated with the media data of enhancement layer bits that may be omitted in a transmission, transmitting the bit stream via the second transmission excluding omitted bits, and transmitting the bit stream via the third transmission including the omitted bits.

7. The method according to claim 3, wherein the first or second transmitter sites of the broadcast area perform the first transmission each utilizing one and a same frequency and/or time resource and perform at least one of the second and third transmissions utilizing different frequency and/or time resources.

8. The method according to claim 1, wherein one and a same broadcast signal representing the media data is transmitted in the first transmission and in the second transmission, and the second transmission utilizes more transmission resources than the first transmission.

9. The method according to claim 1, wherein the first transmission comprises transmitting a single representation of the media data and the second transmission comprises transmitting multiple representations of the media data.

10. The method according to claim 1, comprising the further steps of:

transmitting a subset of the media data via the first transmission, and transmitting the media data via the second transmission.

11. The method according to claim 1, comprising the further steps of:

indicating in a bit stream associated with the media data that may be omitted in a transmission, transmitting the bit stream via the first transmission excluding omitted bits, and transmitting the bit stream via the second transmission including the omitted bits.

12. A method of controlling a wireless broadcast transmission of media data via multiple transmitter sites into a broadcast area with different transmitter inter-site distances, wherein the method comprises the steps of:

determining a region of large transmitter inter-site distance and a region of small transmitter inter-site distance based on a distance threshold between the multiple transmitter sites in the broadcast area;

initiating a first transmission of the media data into a cell served by a transmitter site for reception in the region of large transmitter inter-site distance; and initiating a second transmission of the media data of different quality into the cell for reception in the region of small transmitter inter-site distance.

13. The method according to claim 12, wherein the media data comprise hierarchically layered data with at least a base layer and an enhancement layer, and wherein the first transmission comprises a transmission of the base layer and the second transmission comprises a transmission of the enhancement layer.

14. The method according to claim 12, wherein one and a same broadcast signal representing the media data is transmitted in the first transmission and in the second transmission utilizing different transmission resources.

15. A method of receiving a wireless broadcast transmission of media data via multiple transmitter sites into a broadcast area with different transmitter inter-site distances, wherein the broadcast area comprises at least a region of large transmitter inter-site distance and a region of small transmitter inter-site distance, and wherein the method comprises the steps of:

receiving a first transmission of the media data from at least one transmitter site for reception in the region of large transmitter inter-site distance; and receiving a second transmission of the media data of different quality from at least one transmitter site for reception in the region of small transmitter inter-site distance, the region of large transmitter inter-site distance and the region of small transmitter inter-site distance being based on a distance threshold between the multiple transmitter sites in the broadcast area.

16. The method according to claim 15, wherein the media data comprise hierarchically layered data with at least a base layer and an enhancement layer, and wherein the first transmission comprises a transmission of the base layer and the second transmission comprises a transmission of the enhancement layer.

17. The method according to claim 15, wherein one and a same broadcast signal representing the media data is transmitted in the first transmission and in the second transmission utilizing different transmission resources.

18. A broadcast control system for controlling a wireless broadcast transmission of media data via multiple transmitter sites into a broadcast area with different transmitter inter-site distances, wherein the system comprises:

a component for determining a region of large transmitter inter-site distance and a region of small transmitter inter-site distance based on a distance threshold between the multiple transmitter sites in the broadcast area;

at least one first transmission control component for initiating a first transmission of the media data to a first transmitter site in the region of large transmitter inter-site distance; and at least one second transmission control component for initiating a second transmission of the media data of different quality to a second transmitter site in the region of small transmitter inter-site distance.

19. The broadcast control system according to claim 18, wherein the media data comprise hierarchically layered data with at least a base layer and an enhancement layer, and wherein the first transmission is a transmission of the base layer and the second transmission is a transmission of the enhancement layer.

20. The broadcast control system according to claim 18, wherein the first transmission comprises a single representation of the media data and the second transmission comprises multiple representations of the media data.

21. A transmitter for controlling a wireless broadcast transmission of media data via multiple transmitter sites into a broadcast area with different transmitter inter-site distances, wherein the transmitter comprises:

a component for determining a region of large transmitter inter-site distance and a region of small transmitter inter-site distance based on a distance threshold between the multiple transmitter sites in the broadcast area;

a first transmission control component for initiating a first transmission of the media data into a cell of the broadcast area served by the transmitter for reception in the region of large transmitter inter-site distance; and a second transmission control component for initiating a second transmission of the media data of different quality into the cell for reception in the region of small transmitter inter-site distance.

22. A receiver stage for receiving a wireless broadcast transmission of media data via multiple transmitter sites into a broadcast area with different transmitter inter-site distances, wherein the broadcast area comprises at least a region of large transmitter inter-site distance and a region of small transmitter inter-site distance, and wherein the receiver stage comprises:

a first interface component for receiving a first transmission of the media data from at least one transmitter site for reception in the region of large transmitter inter-site distance; and a second interface component for receiving a second transmission of the media data of different quality from at least one transmitter site for reception in the region of small transmitter inter-site distance, the region of large transmitter inter-site distance and the region of small transmitter inter-site distance being based on a distance threshold between the multiple transmitter sites in the broadcast area.

23. The receiver stage of claim 22, wherein the receiver stage is part of user equipment for a mobile network.

* * * * *